United States Patent [19]

John

[11] 4,001,051

[45] Jan. 4, 1977

[54] METHOD AND APPARATUS FOR PROTECTING SUPPORT ELEMENTS FOR CAST METAL STRANDS DURING STRAND CUTTING

[75] Inventor: Carl John, Hochdahl, Germany

[73] Assignee: Demag, A.G., Duisburg, Germany

[22] Filed: Feb. 20, 1975

[21] Appl. No.: 551,326

[30] Foreign Application Priority Data

Nov. 27, 1974 Germany ..... 2502615
Feb. 23, 1974 Germany ..... 2408855

[52] U.S. Cl. ..... 148/9 R; 266/50; 164/263

[51] Int. Cl.[2] ..... B23K 31/10

[58] Field of Search ..... 148/9 R; 164/262, 263; 198/127 R; 266/23 R, 23 KC, 50

[56] References Cited

UNITED STATES PATENTS 3,511,489 5/1970 Field ..... 266/23 KC
3,788,620 1/1974 Lotz ..... 266/23 KC

FOREIGN PATENTS OR APPLICATIONS 1,810,951 8/1970 Germany ..... 164/263

*Primary Examiner*—Roy Lake
*Assistant Examiner*—Paul A. Bell
*Attorney, Agent, or Firm*—Mandeville and Schweitzer

[57] ABSTRACT

Methods and apparatus are provided for protecting the supporting rolls of continuously moving freshly cast heavy metal strands (e.g., continuously cast billets and slabs), so that the rolls are not damaged by cutting torches while the strands being supported are being worked upon by those torches. This is achieved by sequentially pivoting individual ones of the supporting rolls out of the support path only momentarily as the cutting torch passes in the vicinity thereof, while continuously rotating the retracted support roll, and returning the roll to normal position after the torch has passed. Pivoting movement of a support roll, either in the retracting or return direction is caused to take place during the moments of highest exposure of the roll to flying slag from the torch in order to minimize the time of such exposure. This pivoting sequence of individual rolls takes place while still maintaining proper support of the strand by means of adjacent, operative support rolls. Adequate protection of the rolls is afforded even though the rolls are pivoted in a path somewhat parallel to the support path of the strand and are not retracted far from such path. The new arrangement simplifies the protective covering requirements of the support rolls and enables an inexpensive, rugged pivoting mechanism to be utilized for moving the support rolls. The pivoting devices may be reversible hydraulic cylinders connected to a common pump through an appropriate valving arrangement and may provide for equal or different pivoting speeds in the movement of the various support rolls away from and back to their working positions.

2 Claims, 9 Drawing Figures

METHOD AND APPARATUS FOR PROTECTING SUPPORT ELEMENTS FOR CAST METAL STRANDS DURING STRAND CUTTING

STATEMENT AND BACKGROUND OF THE INVENTION

The invention involves a method and apparatus for avoiding damage to supporting elements which may be arranged at regular or irregular intervals along a continuously moving cast metal strand, resulting from a cutting torch flame which is arranged above the cast metal strand and at right angles thereto. During a cutting operation, the cutting torch moves at the same speed and in the same direction as the cast metal strand until the cut has been completed.

In accordance with the invention, each supporting element pivots out of the support position, individually and sequentially, as the torch flame approaches, with the pivoting movement being generally parallel to the strand path of movement. Such pivoting action serves to avoid any undesirable heating of the supporting elements, which typically are rolls. Because the support rolls tend to receive heat from only one direction, it is difficult to dissipate such heat without subjecting the roll surface to stress from expansion. Heat dissipation and functional operation of the supporting element bearings can be further affected in an undesirable manner by the build-up of slag thrown by the cutting torch unless the roll is properly protected from such build-up. The slag is caused by the cutting flame which burns the strand material forming a spray cone of the slag.

It has been proposed in the past (German DT-OS 1914223) to diminish the undesirable effects of the cutting torch flame on the supporting elements by either arranging the supporting elements in the manner of a chain and moving the supports along at the same speed as the cast metal strand and cutting torch carriage, or else moving the supporting elements out of the way until the cutting flame has passed. However, the synchronism of supporting element and cutting flame does not necessarily avoid the heating of the supporting elements adjacent the torch. Moreover, the pivoting of supporting elements may result in a lack of support of the still-warm cast metal strand if too many are pivoted at the same time. When tilting several rolls simultaneously, considerable flexural elongation of the strand can result and the cast metal strand might buckle severely.

The present invention is based on the necessity of supporting medium and heavy cast metal strands as uniformly and continuously as possible. Removal of the supporting elements must be limited as much as possible in both time and number. Simultaneous tilting of all or several of the supporting elements, according to past practices, can be done only when dealing with minor supporting requirements such as for billets or narrow and/or thin slabs involving relatively light weights per meter of strand length. On the other hand, such practices are disadvantageous even for billets, because a low number of supports causes the spacings between supporting elements to become undesirably large.

Thus, the invention provides a method and means to achieve the greatest protection of the supporting elements against the cutting torch flame while at the same time most effectively providing support for the cast metal strand. The arrangement of the invention is suitable for use in connection with supporting elements arranged in regular and irregular intervals, as well as for bilaterial supporting elements for tilting into parallel position when employing medium and, particularly, heavy cast metal strands.

DESCRIPTION OF THE INVENTION

In accordance with the invention, individual supporting elements are pivoted during the approach of the cutting torch flame in an arc somewhat paralleling the path of strand movement. In one advantageous form of the invention, roll movement in the "retracting" direction may be either (a) opposite to the strand direction of movement at relatively high speed, to quickly pass through the slag spray cone or (b) in the same direction as strand movement at a speed at least equalling the advancing speed of the cutting torch carriage, avoiding the slag spray cone. The supporting element is then restored to its original position, either (a) following and avoiding the cutting torch flame with a speed no more than the advancing speed of the cutting torch flame, or (b) moving at relatively high speed against strand direction of motion and passing quickly through the slag cone. In this way, either the supporting roll is maintained at the periphery of the slag cone moving in the same direction as the movement of the strand, thus avoiding degradation from the slag and heat, or it is pivoted rapidly through the cone with the roll movement taking place during the moment when the heat and slag would be most destructive. The moving action substantially reduces any effect on the roll. Preferably, the drive roll is continuously rotated during the tilting process.

According to the invention, each individual supporting element is only briefly removed from the path of the cast metal strand in order to permit the passing of the cutting torch flame. The tilting direction can be determined by the distance between two given supporting elements. Furthermore, it is an advantageous feature that a support roll may be maintained at a position outside of the slag spray cone, even though the supporting element is pivoted through an arc largely parallel to the strand path. Because of this fact, there can be a substantial reduction in the strength requirements of parts as compared to arrangements providing for lateral (right angle) pivoting action. This advantageous arrangement is achieved by keeping the space between two supporting elements sufficiently free of any parts and devices, at least on one side thereof, so that the pivoting mechanism of the pivoting devices can be placed therebetween. Therefore, the pivoting mechanisms are both easily accessible from the exterior, and protected against spraying slag.

The apparatus in accordance with the invention includes arrangements for supporting the journal bearings of each supporting roll on levers. The levers pivot around a stationary pivot positioned about midway thereof and having the associated supporting roll bearing at one end and the pivoting mechanism attached to the other end. The apparatus is arranged so that the pivoting mechanisms are arranged in an easily accessible, yet protected space. The mechanisms include double acting pressure fluid (hydraulic) cylinders, the longitudinal axes of which are at a low angle (e.g., smaller than 45°) to the strand axis.

Preferably, the supporting element rolls have rotary drives which are disposed directly at one journal bearing for the rolls, usually with the interposition of a reduction gear, and they are provided with stop means on the journal bearing lever against the effects of torque.

It should be understood that although the invention is being described in terms of a horizontally moving, continuously cast heavy metal strand, that it is within the purview of this invention to utilize the advantages thereof with respect to vertically moving cast strands as well.

In a further embodiment of the invention, the pivoting mechanisms for the supporting element rolls may be so connected that they are pivoted under the action of appropriate controls and valves sequentially at approximately the same speed out of support position and back into support position. With this embodiment, the individual rolls are pivoted rapidly out of supporting position. Then, the rolls dwell for a period until the cutting torch is out of range and then pivot rapidly back into supporting position. By permitting the pivoting action to take place at similar speeds in both directions, pumping and control requirements are simplified, and a single pump may be utilized to operate the several mechanisms. Also with this embodiment more supporting rolls may be used for a given weight of cast metal strand, and the individual ones of the rolls are out of supporting engagement for a shorter period of time. This reduces the length of non-supporting strand at any one time.

Among the advantages obtained with the apparatus according to this invention are that the pivoting direction for the supporting elements can be in either or both directions. The arrangement of the pivoting mechanisms in the space below or to one side of the strand course makes them easily accessible from the exterior and at the same time protected from slag. This, in turn, leads to a simplification of the roll supporting structure and pivoting devices. Compared with other devices, the weight reductions resulting from this are considerable, e.g., 30% and over. The new method of pivoting the supporting elements, nevertheless, increases the safety of the supporting elements from damage caused by the cutting torch flame.

DETAILED DESCRIPTION OF THE DRAWINGS

Figure 1B:
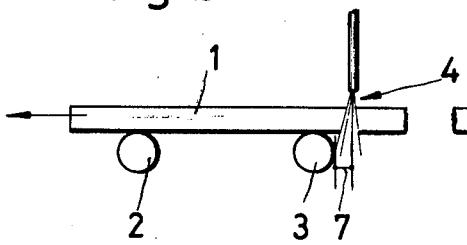
FIGS. 1*b*, 2*b* and 3*b* are a schematic showing of the pivoting procedure according to another embodiment of the invention with initial pivoting movement being in the same direction as the movement of the supported strands.
Figure 1A:
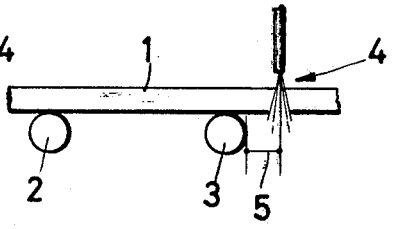
FIGS. 1*a*, 2*a* and 3*a* are a schematic showing of the pivoting procedure according to one embodiment of the invention, with initial pivoting movement being against the direction of movement of the supported strand.
Figure 2B:
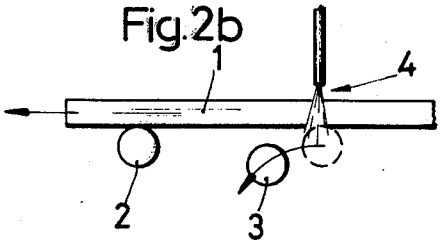
Figure 2A:
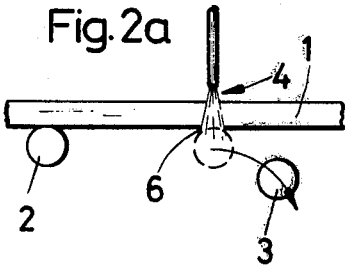
Figure 3B:
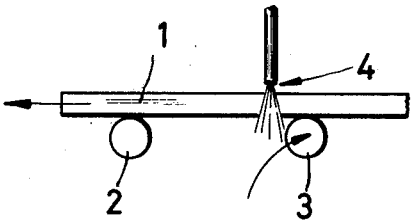
Figure 3A:
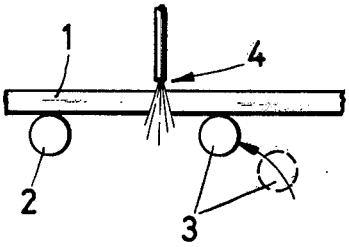

Referring first to FIGS. 1, 2 and 3, a cast metal strand 1 from a continuous casting process, rests on rows of supporting elements forming a support structure including vertical and curved support areas (not shown) and a horizontal support area. A plurality of supporting rolls, of which supporting rolls 2 and 3 are representative, define a path of movement for the strand 1. A cutting torch flame 4 is shown at a distance 5 from the supporting roll (FIG. 1*a*). During the approach of the cutting torch flame 4 (from right to left in FIG. 1*a*), roll 3 is pivoted at great speed into the position shown in FIG. 2*a*, right through the slag spray cone 6 of the cutting torch flame 4. As soon as the cutting torch flame 4 has left or is beginning to leave the basic support position of the supporting roll 3, the supporting roll 3 is returned from the position shown in FIG. 2*a* back to the basic support position shown in FIG. 3*a*, following the movement of the cutting torch flame 4.

An alternative procedure is shown in FIGS. 1*b*, 2*b* and 3*b*. As soon as the cutting torch flame 4 has approached the supporting roll 3, up to minimum preset distance 7 (FIG. 1*b*), the supporting roll 3 begins to pivot away from the flame, maintaining a minimum distance 7 as shown in FIG. 2*b*. During this period, the cutting torch flame 4 is gradually leaving the zone in which it could damage the supporting roll 3 while in its basic supporting position, and approaches the non-supporting position of the supporting roll 3 (FIG. 2*b*). In this position, the cutting torch flame 4 is not dangerously close to the pivoted supporting roll 3, and is far enough removed from the basic support position of the supporting roll 3. At this moment, the roll 3 is pivoted very quickly through the slag spray cone 6 and is returned to its basic supporting position (FIG. 3*b*).

Both of the procedures illustrated in FIGS. 1–3*a* and 1–3*b* subject the supporting roll 3 to heat radiation and/or slag spraying only during the limited period of the pivoting process through the slag spray cone 6. Practice has shown that the supporting roll is, surprisingly, hardly heated at all when pivoting through cutting torch flame 4, contrary to previously known methods of pivoting, where the supporting rolls are kept motionless for some time in a specified position. Also, if rotation of the supporting rolls is maintained during the pivoting process, there is even less chance of unbalanced heat radiation.

Figure 4:
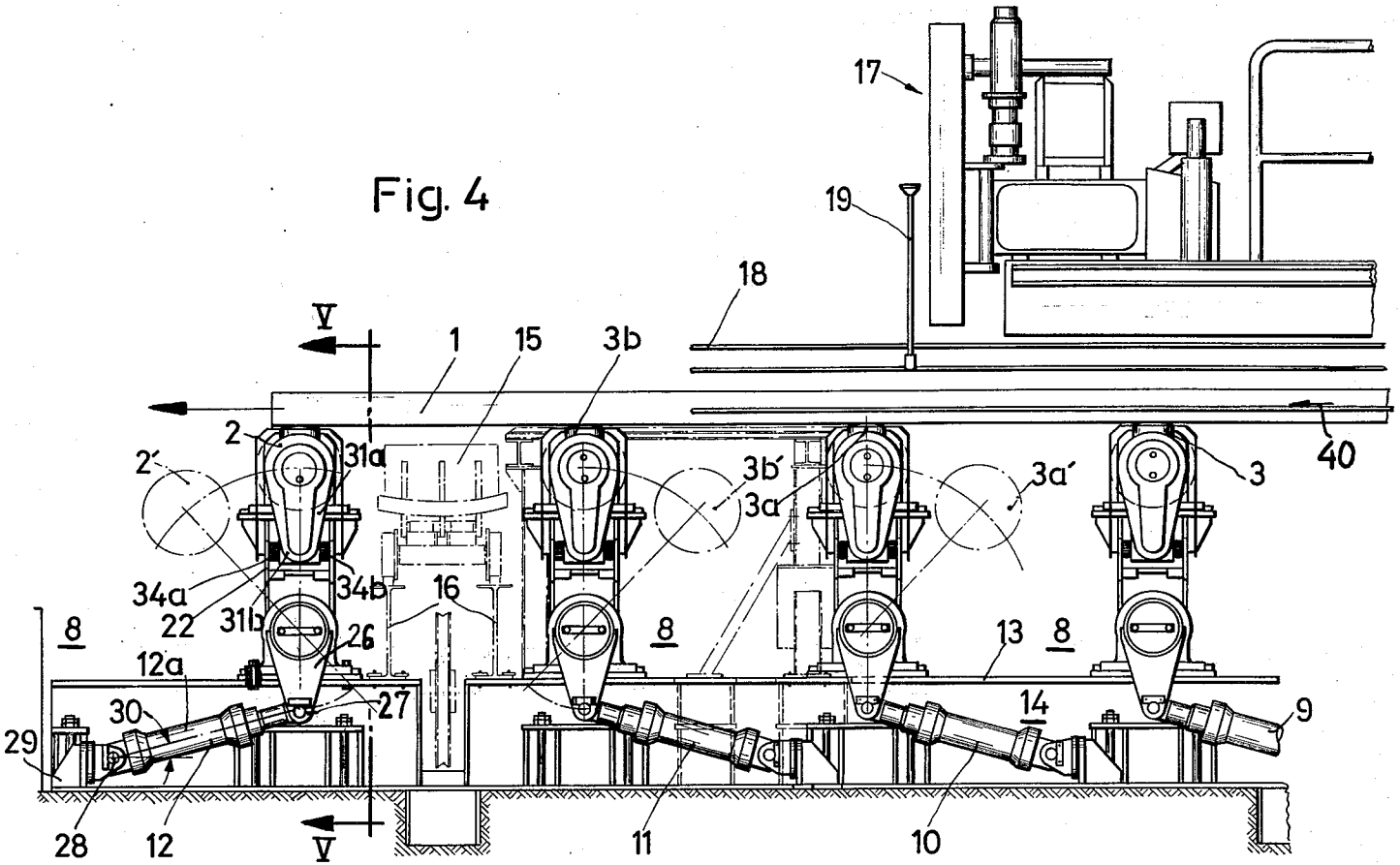
FIG. 4 is a somewhat diagrammatic side elevational view of apparatus of the invention with several successive supporting elements for the cast metal strand and with a cutting torch carriage above.

The methods described above are repeated in sequence with the supporting rolls 2 and other rolls in the supporting sequence. Referring now to FIG. 4, the path of movement of the cast metal strand is formed by supporting rolls 3, 3*a*, 3*b* and 2. The cast metal strand 1 travels from the casting mold (not shown here) in the direction of the arrow 40. There is a space 8 between each two supporting rolls, which is kept sufficiently free of any parts and devices on at least one side of each supporting roll, to allow for pivoting of the supporting rolls. Below the space 8 there are pivoting mechanisms 9, 10, 11 and 12 of independent pivoting devices for the respective supporting rolls 3, 3*a*, 3*b* and 2. The pivoting mechanism 9 – 12 are located in an area 14, separated by means of screen wall 13, the area 14 offering protection against falling scale and/or slag spray from the cutting torch flame 4. Alternatively, the screen wall 13 may be raised higher, with openings to accommodate the pivoted movements of the rolls, to offer even more protection thereto. In the example shown, the area 14 is not arranged directly adjacent the rolls 3 and 2 respectively, but more in the marginal area of the supporting elements. It is, however, also possible to arrange the pivoting mechanisms 9 – 12 directly adjacent the supporting rolls 3, 3*a*, 3*b* and 2. In this case, the foundation would be provided with access areas for maintenance of the pivoting mechanisms.

In FIG. 4, the spaces 8 are free of parts to accommodate a pivoting movement to the right of the supporting elements. In one spot of the apparatus, however, there is provision for a transverse vehicle 15, its rails 16 reaching into the space 8. For this reason, the space 8 for the supporting roll 2 has been moved to the left and, therefore, the supporting roll 2 can be tilted to the left. In this manner, the transverse vehicle 15 can pick up scraps of the cast metal strand.

Above the level formed by the supporting rolls 3, 3*a*, 3*b* and 2, a cutting torch carriage 17 runs on rails 18. It carries a torch nozzle 19 producing a cutting torch flame such as the flame 4 in FIGS. 1 and 2. In FIG. 4, the position of the cutting torch carriage 17 is shown with the cutting torch nozzle 19 in a position where supporting roll 3*a* has already been pivoted into position 3*a*'. Analogous positions are indicated for the supporting roll 3*b* by 3*b*' and for the roll 2 by 2'. Pivoting devices are provided for all of the supporting rolls 3, 3*a*, 3*b* and 2, and, in accordance with FIG. 4, they only differ in the position of the pivoting mechanism, depending upon the desired pivoting direction.

Figure 5:
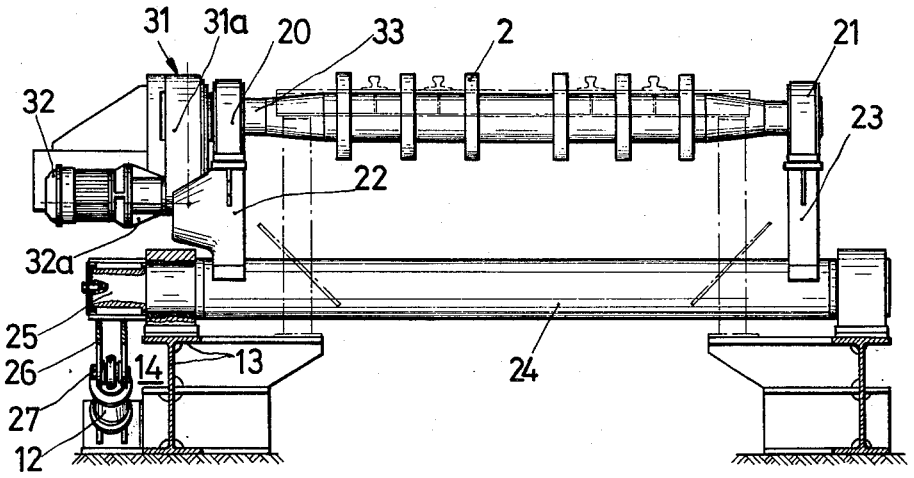
FIG. 5 is a cross sectional view taken along lines V—V of FIG. 4.

Referring to FIG. 5, a representative supporting element with supporting roll 2 is shown supported in journal bearings 20 and 21. The bearings 20 and 21 are, in turn, supported on levers 22 and 23, respectively. The levers 22 and 23 are rigidly connected by an axle 24. The lever 22, together with a journal shaft 25 and another lever 26, form a double arm lever, the pivoting mechanism 12 being connected to the lever arm 26. In this example, a reversible hydraulic actuator is shown as representative of the pivoting mechanism, with its piston rod connected to the lever arm 26 at journal coupling 27. A similar journal coupling 28 (FIG. 4) is provided for mounting the cylinder of the pivot mechanism 12 at 29.

Advantageously the several pivot cylinders 9 – 12 are positioned so that their longitudinal axes 12*a*, in the basic position shown in FIG. 4, are aligned in the direction of the strand path and at an acute angle 30 with the horizontal plane of strand 1. Supporting rolls 2, 3, 3*a*, 3*b* each are driven through a reduction gear 31, and by individual rotary drives 32 directly at their respective journals 33. Rotary drive casing 32*a* and gear casting 31*a*, respectively, are secured from turning against lever 22. For this purpose, the gear casing 31*a* (FIG. 4) has a torque arm 31*b*, which is held between bumpers 34*a* and 34*b* on lever 22. Therefore, gear 31 and rotary drive 32 join in the pivoting motion of lever 22.

Figure 6:
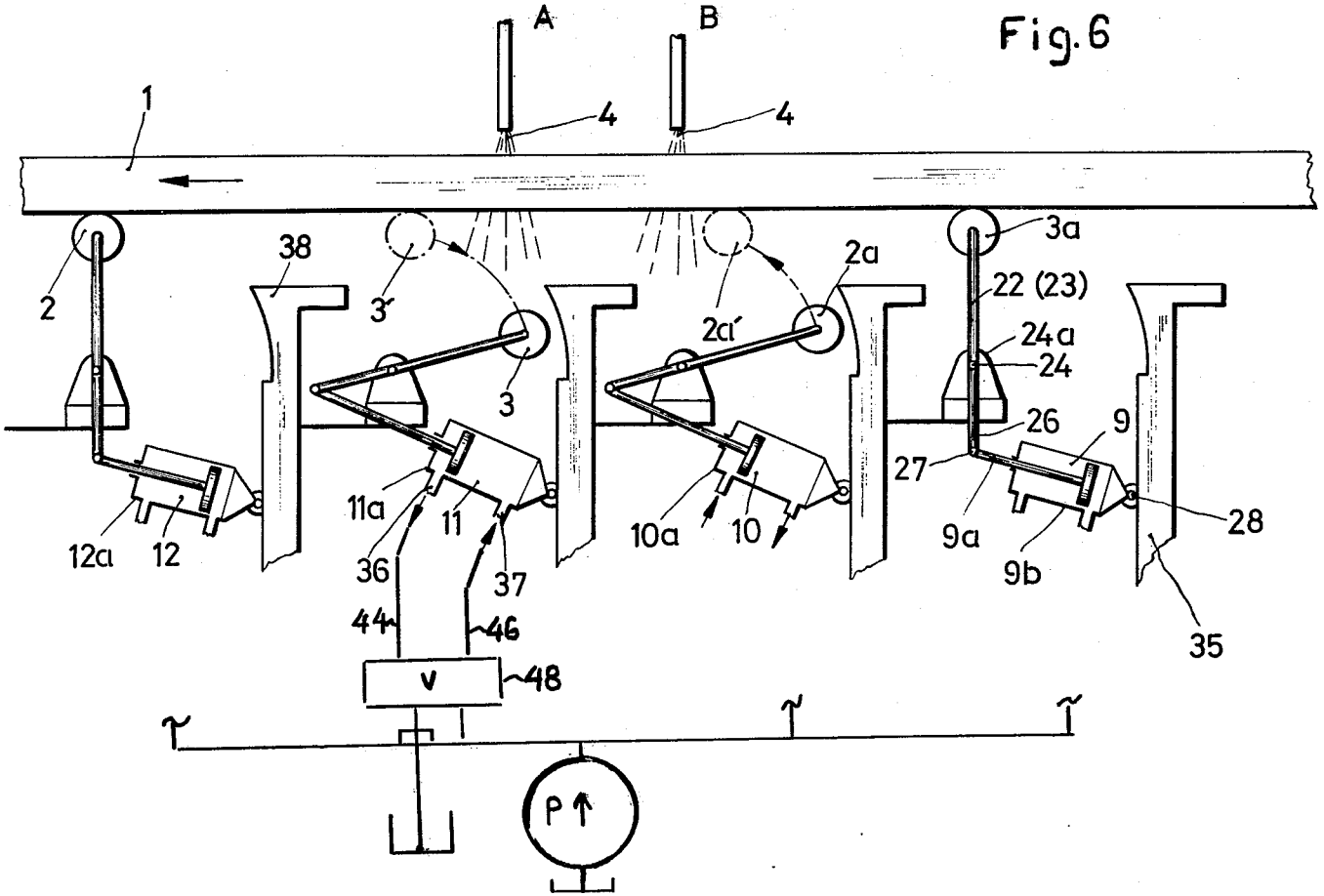
FIG. 6 is a schematic showing of a view similar to FIG. 4, of a further embodiment of the invention, in which the support rolls can be pivoted at similar speeds in both directions.

Referring now to the embodiment shown in FIG. 6, a supporting element in this embodiment is kept in the pivoted position for the brief period of time it takes the cutting flame to pass the position normally occupied by the supporting element in its supporting position. A retracted support can then be returned to its supporting positon after the cutting torch flame has arrived at a proper distance from this supporting position, at about the same speed that was used to tilt it out of the way. This embodiment changes the time allotted between pivoting away from and returning to the strand supporting position. It is based on the assumption that the time periods required for pivoting and returning are relatively short, while the duration of the cutting torch flame passing the supporting position is considerably longer. A great advantage of this embodiment is that the supporting element is kept out of reach of spraying slag from the cutting torch flame for the longest period of time. Moreover, this embodiment has fewer control requirements and the system may be simplified by connecting the several piston-cylinder engines to a common pump.

In order to achieve adequate speeds for pivoting movements of the supporting elements, it is sufficient to charge each individual piston-cylinder engine with the same pressure to produce generally equal piston speed. There is no need for special controls in each direction because of the difference in size of the piston compression areas on either side.

FIG. 6 shows an example of the apparatus in accordance with the last mentioned embodiment. A cast metal strand 1 rests on supporting elements 2 and 3 as well as 2*a* and 3*a*, consisting of supporting rolls, and it moves in the direction indicated by an arrow 40. The supporting elements are attached to parallel levers 22 and 23, respectively, with the levers 23 being on the opposite side of the view and not therefore shown. The levers 22 and 23 pivot around axes 24 with portions 26 of the levers extending below the axes 24. The lever 22, together with the axes 24 and lever portion 26, forms a double arm lever. The axes 24 are formed by axles, as in FIGS. 4 and 5, resting on bearings 24*a* arranged on the supporting element frames 35. The pivoting mechanism consists of pressure fluid piston and cylinders 9 – 12, hinged to the lever arms 26 via piston rods 9*a* by means of journal couplings 27. The cylinder casings 9*b* are supported on the frames 35 via similar journal couplings 28. Each cylinder casing 9*b*, 10*a*, 11*a*, 12*a* is connected to a common pump 42 via lines 44 and 46 connected to ports 36 and 37, and via appropriate valves 48 controlled by appropriate tripping mechanisms, as will be understood in the art.

The supporting elements shown in FIG. 6 form the path above which the rails (not shown) for the cutting torch carriage (not shown) are installed. The equipment of the cutting torch carriage produces a cutting torch flame 4 of oxygen which covers the width of the metal strand (vertically to the plane of the drawing).

The equipment shown in FIG. 6 functions as follows: In position A, the cutting torch flame 4 approaches supporting element 3, for example, which is tilted downward by operating the piston cylinder 11 before any spraying slag can reach supporting element 3 in its supporting position. The supporting element remains in the downward-tilted position. Cover 38 may be provided on the frame 35 offering extra protection for the supporting element in its non-supporting position, as shown with respect to rolls 2*a* and 3 in FIG. 6. After the cutting torch flame 4 has passed, the situation is as shown with the cutting flame 4 in position B with respect to the supporting element 2*a*. The supporting element 2*a* is at this time returned into supporting position 2*a*'. During downward and upward tilting the same pressures exist at ports 36 and 37 for the compression parts of a piston, such pressures being produced by pump 42.

Thus, as will be apparent from the foregoing, there are provided in accordance with the invention, methods and apparatus for protecting the support rolls of a continuously moving cast metal strand from damage or deterioration by a cutting torch acting on that strand. This is achieved by pivoting the support rolls substantially parallel to the path of movement of the strand in either direction in arcs adjacent that path of movement, while utilizing the motion of the pivoting movement to avoid damage during periods of direct contact with the torch or slag cone from the torch. Because the pivoting movements are parallel to the path of movement of the strand being cut, the supporting structures for the rolls are substantially less complicated and reduced in size.

While the methods and forms of apparatus described herein constitute preferred embodiments of this invention, it is to be understood that the invention is not limited to these precise methods and forms of apparatus, and that changes may be made therein without departing from the scope of this invention, which is described in the appended claims.

I claim:

1. A method for protecting the support rolls of a freshly cast continuous metal strand from damage and deterioration from the effects of a cutting torch working on that strand; the steps which comprise a. moving said strand continuously over a plurality of spaced transverse support rolls while continuously moving a cutting torch therewith;

b. pivoting individual ones of said support rolls from a support position against said strand to a non-support position away from said strand and back sequentially as said cutting torch passes adjacent the support position of the respective individual support rolls, said support position and said non-support position being parallel to each other;

c. the movement of the individual support rolls being in arcs adjacent and substantially parallel to the path of movement of said strand;

d. the sequential movement of said rolls from one position to another being during moments of highest exposure in the support position to the effects of said cutting torch and in direct relation to the movement thereof;

e. the movement of said rolls in the same direction of said torch being at the same speed as the speed of advance of said torch, and maintained at periphery of the spray cone; and f. the pivoting speed of said support rolls in a direction opposite said cutting torch movement being greater than the pivoting speed of said rolls in the same direction as said cutting torch movement and through the spray cone thereof.

2. The method of claim 1, in which a. said plurality of support rolls are continuously rotated during the pivoting movements thereof from the support position thereof to the non-support position and return.

* * * * *